US006550080B1

(12) United States Patent
Grewal

(10) Patent No.: US 6,550,080 B1
(45) Date of Patent: Apr. 22, 2003

(54) SHOWER CLEANING APPARATUS

(76) Inventor: Gurbir Grewal, 1442 Kirkrow Crescent, Mississauga Ontario L5M 3Y5 (CA)

( * ) Notice: Subject to any disclaimer, the term of this patent is extended or adjusted under 35 U.S.C. 154(b) by 0 days.

(21) Appl. No.: 09/910,262

(22) Filed: Jul. 20, 2001

(51) Int. Cl.[7] ..... A47K 3/28
(52) U.S. Cl. ..... 4/662; 4/601
(58) Field of Search ..... 4/601, 602, 662

(56) References Cited

U.S. PATENT DOCUMENTS

| | | | | |
|---|---|---|---|---|
| 3,742,520 A | | 7/1973 | Bernardi | |
| 3,747,129 A | | 7/1973 | Dyar | |
| 3,755,826 A | * | 9/1973 | Roberts | 4/662 |
| 3,822,826 A | * | 7/1974 | Wilson | 4/601 X |
| 4,256,263 A | | 3/1981 | Green et al. | |
| 4,383,341 A | | 5/1983 | Altman | |
| 4,872,225 A | * | 10/1989 | Wagner | 4/662 |
| D315,393 S | | 3/1991 | Presman | |
| 5,452,485 A | | 9/1995 | Ross | |
| 5,507,436 A | | 4/1996 | Ruttenberg | |
| 6,079,060 A | * | 6/2000 | Walker | 4/601 |

FOREIGN PATENT DOCUMENTS

| | | | | |
|---|---|---|---|---|
| EP | 0401118 | * | 5/1990 | 4/601 |

* cited by examiner

*Primary Examiner*—Charles E. Phillips

(57) ABSTRACT

A shower cleaning apparatus for effectively cleaning and rinsing down the bathtub or shower stall after the use thereof. The shower cleaning apparatus includes a plurality of tubular members having bores extending therethrough and including a first tubular member being adapted to be securely connected to a pipeline for a shower head; and also includes a plurality of connecting members for connecting the tubular members together with the connecting members having bores extending therethrough; and further includes one or more nozzles being securely connected to the tubular members and being adapted to be disposed above a bathtub or a shower stall for dispensing and spraying water therefrom; and also includes a regulating and controlling assembly for regulating and controlling flow of water to the one or more nozzles.

16 Claims, 2 Drawing Sheets

SHOWER CLEANING APPARATUS

BACKGROUND OF THE INVENTION

1. Field of the Invention

The present invention relates to a shower cleaner and more particularly pertains to a new shower cleaning apparatus for effectively cleaning and rinsing down the bathtub or shower stall after the use thereof.

2. Description of the Prior Art

The use of a shower cleaner is known in the prior art. More specifically, a shower cleaner heretofore devised and utilized are known.to consist basically of familiar, expected and obvious structural configurations, notwithstanding the myriad of designs encompassed by the crowded prior art which have been developed for the fulfillment of countless objectives and requirements.

Known prior art includes,U.S. Pat. No. 3,742,520; U.S. Pat. No. 5,452,485; U.S. Pat. No. 4,383,341; .U.S. Pat. No. 4,256,263; U.S. Pat. No. 5,507,436; and U.S. Pat. No. 3,747,129.

While these devices fulfill their respective, particular objectives and requirements, the aforementioned patents do not disclose a new shower cleaning apparatus. The inventive device includes a plurality of tubular members having bores extending therethrough and including a first tubular member being adapted to be securely connected to a pipeline for a shower head; and also includes a plurality of connecting members for connecting the tubular members together with the.connecting members having bores extending therethrough; and further includes one or more nozzles being securely connected to the tubular members and being adapted to be disposed above a bathtub or a shower stall for dispensing and spraying water therefrom; and also includes a regulating and controlling assembly for regulating and controlling flow of water to the one or more nozzles.

In these respects, the shower cleaning apparatus according to the present invention substantially departs from the conventional concepts and designs of the prior art, and in so doing provides an apparatus primarily developed for the purpose of effectively cleaning and rinsing down the bathtub or shower stall after the use thereof.

SUMMARY OF THE INVENTION

In view of the foregoing disadvantages inherent in the known types of shower cleaner now present in the prior art, the present invention provides a new shower cleaning apparatus construction wherein the same can be utilized for effectively cleaning and rinsing down the bathtub or shower stall after the use thereof.

The general purpose of the present invention, which will be described subsequently in greater detail, is to provide a new shower cleaning apparatus which has many of the advantages of the shower cleaner mentioned heretofore and many novel features that result in a new shower cleaning apparatus which is not anticipated, rendered obvious, suggested, or even implied by any of the prior art shower cleaner, either alone or in any combination thereof.

To attain this, the present invention generally comprises a plurality of tubular members having bores extending therethrough and including a first tubular member being adapted to be securely connected to a pipeline for a shower head; and also includes a plurality of connecting members for connecting the tubular members together with the connecting members having bores extending therethrough; and further includes one or more nozzles being securely connected to the tubular members and being adapted to be disposed above a bathtub or a shower stall for dispensing and spraying water therefrom; and also includes a regulating and controlling assembly for regulating and controlling flow of water to the one or more nozzles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower cleaning apparatus which has many of the advantages of the shower cleaner mentioned heretofore and many novel features that result in a new shower cleaning apparatus which is not anticipated, rendered obvious, suggested, or even implied by any of the prior art shower cleaner, either alone or in any combination thereof.

It is another object of the present invention to provide a new shower cleaning apparatus which may be easily and efficiently manufactured and marketed.

It is a further object of the present invention to provide a new shower cleaning apparatus which is of a durable and reliable construction.

An even further object of the present invention is to provide a new shower cleaning apparatus which is susceptible of a low cost of manufacture with regard to both materials and labor, and which accordingly is then susceptible of low prices of sale to the consuming public, thereby making such shower cleaning apparatus economically available to the buying public.

Still yet another object of the present invention is to provide a new shower cleaning apparatus which provides in the apparatuses and methods of the prior art some of the advantages thereof, while simultaneously overcoming some of the disadvantages normally associated therewith.

Still another object of the present invention is to provide a new shower cleaning apparatus for effectively cleaning and rinsing down the bathtub or shower stall after the use thereof.

Yet another object of the present invention is to provide a new shower cleaning apparatus which includes a plurality of tubular members having bores extending therethrough and including a first tubular member being adapted to be securely connected to a pipeline for a shower head; and also includes a plurality of connecting members for connecting the tubular members together with the connecting members having bores extending therethrough; and further includes one or more nozzles being securely connected to the tubular members and being adapted to be disposed above a bathtub or a shower stall for dispensing and spraying water therefrom; and also includes a regulating and controlling assembly for regulating and controlling flow of water to the one or more nozzles.

Still yet another object of the present invention is to provide a new shower cleaning apparatus that effectively reaches all corners of the bathtub or shower stall without having to make any adjustments.

Even still another object of the present invention is to provide a new shower cleaning apparatus that quickly and conveniently cleans the bathtub or shower stall without the user having to do manually.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
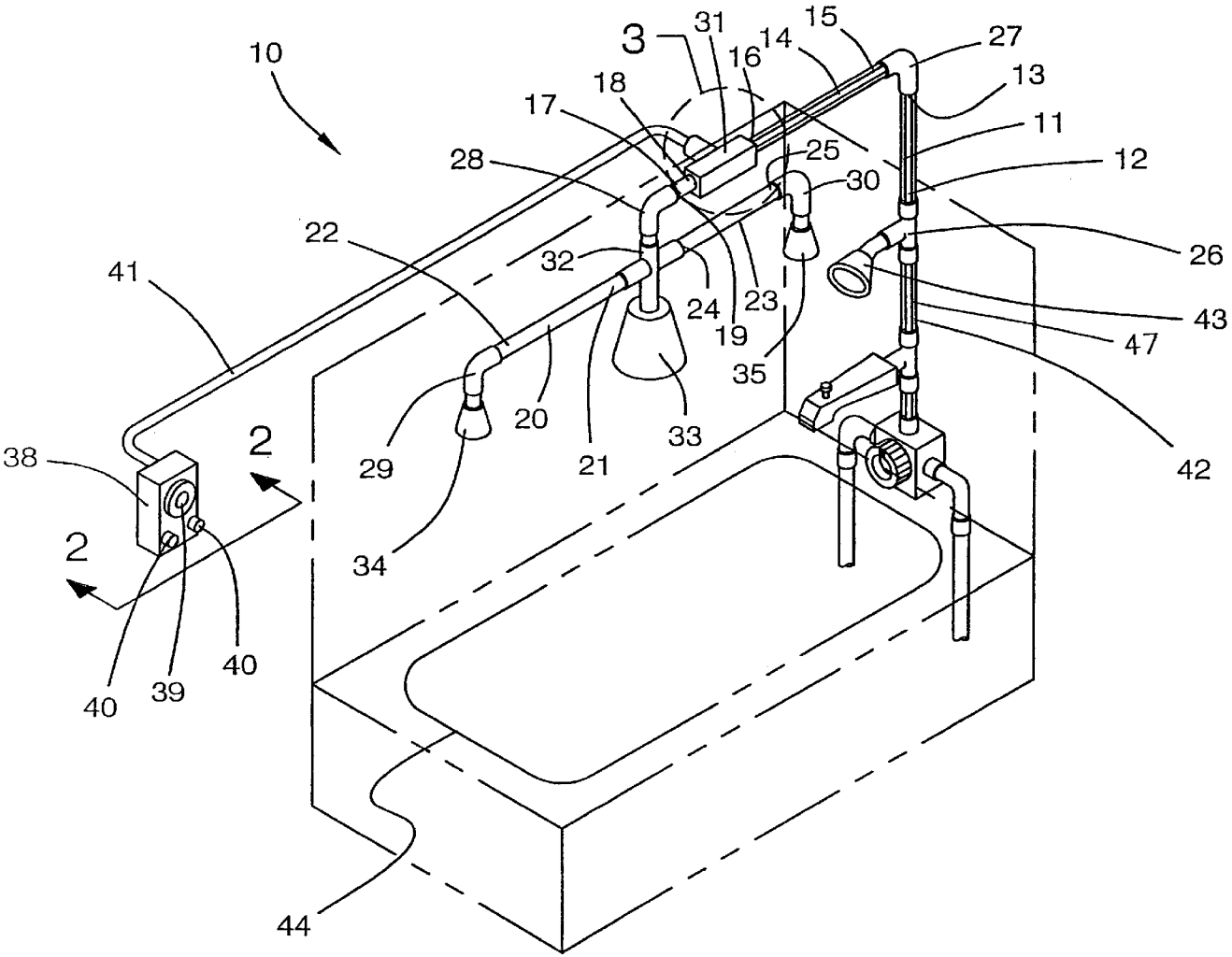
FIG. 1 is a perspective view of a new shower cleaning apparatus according to the present invention.
Figure 3:
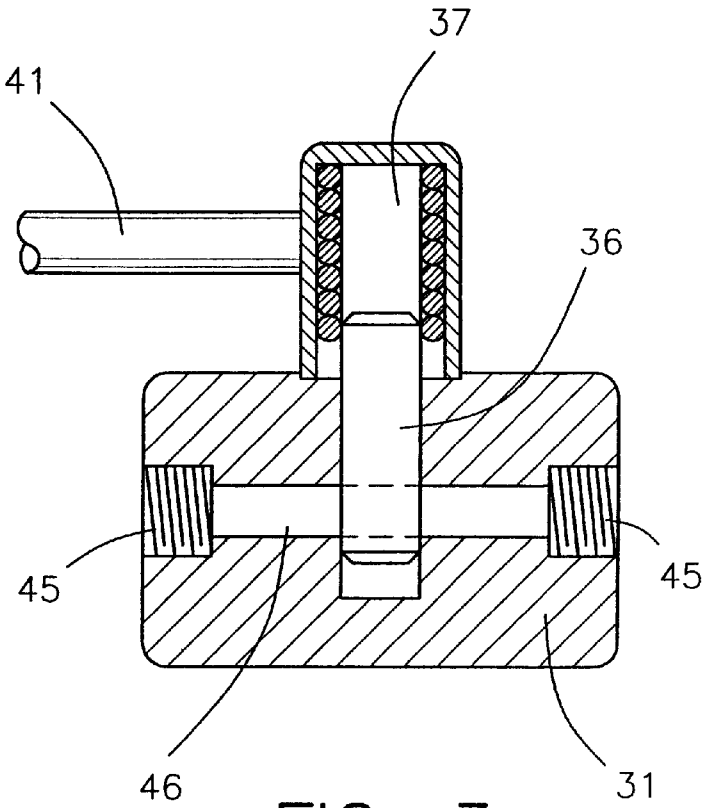
FIG. 3 is a detailed cross-sectional view of solenoid, valve, and inline connecting member of the present invention.
Figure 2:
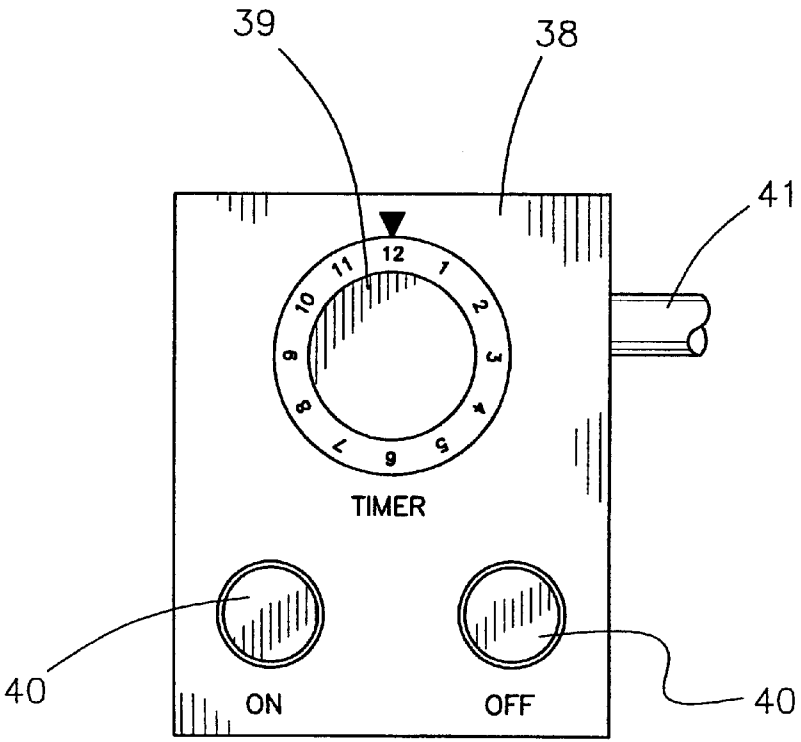
FIG. 2 is a front elevational view of the control unit for the present invention.

With reference now to the drawings, and in particular to FIGS. 1 through 3 thereof, a new shower cleaning apparatus embodying the principles and concepts of the present invention and generally designated by the reference numeral 10 will be described.

As best illustrated in FIGS. 1 through 3, the shower cleaning apparatus 10 generally comprises a plurality of tubular members 11, 14, 17, 20, 23, 47 having bores 45 extending therethrough and including a first tubular member 11 being adapted to be securely and conventionally connected to a pipeline 42 for a shower head 43; and also comprises a plurality of connecting members 26–32 for connecting the tubular members 11, 14, 17, 20, 23, 47 together. The connecting members 26–31 have bores 46 extending therethrough. The connecting members 26–32 include elbow connecting members 27–30 which are securely and conventionally attached to ends of the tubular members 11, 14, 17, 20, 23, 47; and also includes a T-shaped connecting member 26 being conventionally attached to the first tubular member 11. The first tubular member 11 essentially extends vertically and has a first end 12 securely and conventionally attached to the T-shaped connecting member 26 which is adapted to be conventionally connected to the pipeline 42 for the shower head and to the shower head 43 itself, and also has a second end 13 which is securely and conventionally attached to a first elbow connecting member 27. The tubular members 11, 14, 17, 20, 23, 47 include a second tubular member 14 having a first end 15 securely and conventionally attached to the first elbow connecting member 27 and being angled relative to the first tubular member 11 and being adapted to be disposed above the bathtub 44 or shower stall. The second tubular member 14 also has a second end 16 which is securely and conventionally attached to an inline connecting member 31. The tubular members 11, 14, 17, 20, 23, 47 further include a sixth tubular member 47 being adapted to attach to a soap-containing reservoir and being conventionally attached to said one or more nozzles for dispensing soap therethrough. The tubular members 11, 14, 17, 20, 23, 47 also include a third tubular member 17 having a first end 18 securely and conventionally attached to the inline connecting member 31, and also has a second end 19 which is securely and conventionally attached to a second elbow connecting member 28.

One or more nozzles 33–35 are being securely and conventionally depended from the tubular members 17, 20, 23, 47 and are adapted to be disposed above a bathtub 44 or a shower stall for dispensing water therefrom. One or more nozzles 33–35 include a first high pressure nozzle 33 which securely and conventionally depends from the second end 19 of the third tubular member 17 and also depends from said sixth tubular member 47 and which is adapted to be generally centered above the bathtub 44 or shower stall.

Means for regulating and controlling flow of water to the one or more nozzles 33–35 includes a valve member 36 movably and conventionally disposed in the inline connecting member 31 for opening and closing flow of water to the one or more nozzles 33–35, and also includes a solenoid 37 securely and conventionally attached to the inline connecting member. 31 and to the valve member 36, and further includes a control unit 38 securely and conventionally connected to the solenoid 37 with wires 41 and being adapted to be connected to a power source for energizing the solenoid 37. The control unit 38 includes a timer 39 and an on/off switch 40 for energizing the solenoid 37.

As a second embodiment, the connecting members 26–32 includes a cross-shaped connecting member 32 being securely and conventionally attached to the second elbow connecting member 28 with the first high pressure nozzle 33 being securely and conventionally attached to the cross-shaped connecting member 32. The tubular members 11, 14, 17, 20, 23, 47 include a fourth tubular member 20 having a first end 21 securely and conventionally attached to the cross-shaped connecting member 32 with the fourth tubular member 20 extending outwardly therefrom, and also having a second end 22 which is securely and conventionally attached to a third elbow connecting member 29. The tubular members 11, 14, 17, 20, 23, 47 also include a fifth'tubular member 23 having a first end 24 securely and conventionally attached to the cross-shaped connecting member 32 with the fifth tubular member 23 extending outwardly therefrom in a direction opposite to the fourth tubular member 20, and also having a second end 25 which is and securely and conventionally attached to a fourth elbow connecting member 30. The one or more nozzles 33–35 include a second nozzle 34 which is securely and conventionally attached to the third elbow connecting member 29 and is adapted to be suspended above the bathtub 44 or shower stall, and also includes a third nozzle 35 which is securely and conventionally attached to the fourth elbow connecting member 30 and is adapted to be suspended above the bathtub 44 or shower stall.

In use, the user turns open the valve to either the warm or cold water of the conventional pipeline 42 for the shower head and also energizes the solenoid 37 by turning on the switch 40 of the control unit 38 which opens the valve member 36 disposed in the inline connecting member 31 to allow the water to flow to the nozzles 33-35 which sprays water upon the bathtub 44 or the shower stall to effectively and efficiently rinse down all the corners of the bathtub 44 or shower stall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower cleaning apparatus comprising:

a plurality of tubular members having bores extending therethrough and including a first tubular member being adapted to be securely connected to a pipeline for a shower head;

a plurality of connecting members for connecting said tubular members together, said connecting members having bores extending therethrough;

one or more nozzles being securely depended from said tubular members and being adapted to be disposed above a bathtub or a shower stall for dispensing water therefrom;

an inline connecting member being mounted to said tubular members and being positioned between the pipeline and said nozzles and located adjacent to said nozzles;

means for regulating and controlling flow of water to said one or more nozzles;

wherein said means for regulating and controlling flow of water to said one or more nozzles includes a valve member mounted to said inline connecting member for opening and closing flow of water to said one or more nozzles;

a solenoid for actuating said valve member; and a control unit being electrically coupled to said solenoid for energizing said solenoid;

wherein said connecting members include elbow connecting members which are securely attached to ends of said tubular members; and also include a T-shaped connecting member being attached to said first tubular member;

wherein said first tubular member essentially extends vertically and has a first end securely attached to said T-shaped connecting member which is adapted to be connected to the pipeline for the shower head and to the shower head, and also has a second end which is securely attached to a first said elbow connecting member;

wherein said tubular members include a second tubular member having a first end securely attached to said first elbow connecting member and being angled relative to said first tubular member and being adapted to be disposed above the bathtub or shower stall, said second tubular member also having a second end which is securely attached to said inline connecting member;

wherein said valve member is movably disposed in said online connecting member; and wherein said solenoid is mounted to said inline connecting member and is operationally coupled to said valve member.

2. A shower cleaning apparatus as described in claim 1, wherein said tubular members include a third tubular member having a first end securely attached to said inline connecting member, and also having a second end which is securely attached to a second said elbow connecting member.

3. A shower cleaning apparatus as described in claim 2, wherein said tubular members include a sixth tubular member being adapted to attach to a soap-containing reservoir and being attached to said one or more nozzles for dispensing soap therethrough.

4. A shower cleaning apparatus as described in claim 3, wherein said one or more nozzles include a first high pressure nozzle which securely depends from said second end of said third tubular member and also depends from said sixth tubular member and which is adapted to be generally centered above the bathtub or shower stall.

5. A shower cleaning apparatus as described in claim 1, wherein said control unit includes a timer and an on/off switch for energizing said solenoid.

6. A shower cleaning apparatus as described in claim 1, wherein said connecting members includes a cross-shaped connecting member being securely attached to said second elbow connecting member, said first high pressure nozzle being securely attached to said cross-shaped connecting member and depending therefrom.

7. A shower cleaning apparatus as described in claim 6, wherein said tubular members include a fourth tubular member having a first end securely attached to said cross-shaped connecting member with said fourth tubular member extending outwardly therefrom, and also having a second end which is securely attached to a third said elbow connecting member.

8. A shower cleaning apparatus as described in claim 7, wherein said tubular members include a fifth tubular member having a first end securely attached to said cross-shaped connecting member with said fifth tubular member extending outwardly therefrom in a direction opposite to said fourth tubular member, and also having a second end which is securely attached to a fourth said elbow connecting member.

9. A shower cleaning apparatus as described in claim 8, wherein said one or more nozzles include a second nozzle which is securely attached to said third elbow connecting member and being adapted to be suspended above the bathtub or shower stall; and also include a third nozzle which is securely attached to said fourth elbow connecting member and being adapted to be suspended above the bathtub or shower stall.

10. A shower cleaning apparatus comprising:

a plurality of tubular members having bores extending therethrough and including a first tubular member being adapted to be securely connected to a pipeline for a shower head;

a plurality of connecting members for connecting said tubular members together, said connecting members having bores extending therethrough, said connecting members including elbow connecting members which are securely attached to ends of said tubular members; and also including a T-shaped connecting member also being attached to said first tubular member, said first tubular member essentially extending vertically and having a first end securely attached to said T-shaped connecting member which is adapted to be connecting to the pipeline for the shower head and to the shower head, and also having a second end which is securely attached to a first said elbow connecting member, said tubular members including a second tubular member having a first end securely attached to said first elbow connecting member and being angled relative to said first tubular member and being adapted to be disposed above the bathtub or shower stall, said second tubular member also having a second end which is securely attached to an inline connecting member, said tubular members including a sixth tubular member being adapted to attach to a soap-containing reservoir and being attached to said one or more nozzles for dispensing soap therethrough, said tubular members also including a third tubular member having a first end securely attached to said inline connecting member, and also having a second end which is securely attached to a second said elbow connecting member;

one or more nozzles being securely depended from said tubular members and being adapted to be disposed above a bathtub or a shower stall for dispensing water therefrom, said one or more nozzles including a first high pressure nozzle which securely depends from said second end of said third tubular member and also depends from said sixth tubular member and which is adapted to be generally centered above the bathtub or shower stall;

means for regulating and controlling flow of water to said one or more nozzles including a valve member movably disposed in said inline connecting member for opening and closing flow of water to said one or more nozzles, and also including a solenoid securely attached to said inline connecting member and to said valve member, and further including a control unit securely connected to said solenoid and being adapted to be connected to a power source for energizing said solenoid, said control unit including a timer and an on/off switch for energizing said solenoid;

wherein said connecting members includes a cross-shaped connecting member being securely attached to said second elbow connecting member, said first high pressure nozzle being securely attached to said cross-shaped connecting member, said tubular members including a fourth tubular member having a first end securely attached to said cross-shaped connecting member with said fourth tubular member extending outwardly therefrom, and also having a second end which is securely attached to a third said elbow connecting member, said tubular members including a fifth tubular member having a first end securely attached to said cross-shaped connecting member with said fifth tubular member extending outwardly therefrom in a direction opposite to said fourth tubular member, and also having a second end which is securely attached to a fourth said elbow connecting member, said one or more nozzles including a second nozzle which is securely attached to said third elbow connecting member and being adapted to be suspended above the bathtub or shower stall, and also including a third nozzle which is securely attached to said fourth elbow connecting member and being adapted to be suspended above the bathtub or shower stall.

11. A shower cleaning apparatus comprising:

a plurality of tubular members having bores extending therethrough and including a first tubular member being adapted to be securely connected to a pipeline for a shower head;

a plurality of connecting members for connecting said tubular members together, said connecting members having bores extending therethrough;

one or more nozzles being securely depended from said tubular members and being adapted to be disposed above a bathtub or a shower stall for dispensing water therefrom;

means for regulating and controlling flow of water to said one or more nozzles;

wherein said connecting members include elbow connecting members which are securely attached to ends of said tubular members; and also include a T-shaped connecting member being attached to said first tubular member;

wherein said first tubular member essentially extends vertically and has a first end securely attached to said T-shaped connecting member which is adapted to be connecting to the pipeline for the shower head and to the shower head, and also has a second end which is securely attached to a first said elbow connecting member;

wherein said tubular members include a second tubular member having a first end securely attached to said first elbow connecting member and being angled relative to said first tubular member and being adapted to be disposed above the bathtub or shower stall, said second tubular member also having a second end which is securely attached to an inline connecting member;

wherein said tubular members include a third tubular member having a first end securely attached to said inline connecting member, and also having a second end which is securely attached to a second said elbow connecting member;

wherein said tubular members include a sixth tubular member being adapted to attach to a soap-containing reservoir and being attached to said one or more nozzles for dispensing soap therethrough;

wherein said one or more nozzles include a first high pressure nozzle which securely depends from said second end of said third tubular member and also depends from said sixth tubular member and which is adapted to be generally centered above the bathtub or shower stall; and wherein said means for regulating and controlling flow of water to said one or more nozzles includes a valve member movably disposed in said inline connecting member for opening and closing flow of water to said one or more nozzles; and also includes a solenoid securely attached to said inline connecting member and to said valve member; and further includes a control unit securely connected to said solenoid and being adapted to be connected to a power source for energizing said solenoid.

12. A shower cleaning apparatus as described in claim 11, wherein said control unit includes a timer and an on/off switch for energizing said solenoid.

13. A shower cleaning apparatus as described in claim 12, wherein said connecting members includes a cross-shaped connecting member being securely attached to said second elbow connecting member, said first high pressure nozzle being securely attached to said cross-shaped connecting member and depending therefrom.

14. A shower cleaning apparatus as described in claim 13, wherein said tubular members include a fourth tubular member having a first end securely attached to said cross-shaped connecting member with said fourth tubular member extending outwardly therefrom, and also having a second end which is securely attached to a third said elbow connecting member.

15. A shower cleaning apparatus as described in claim 14, wherein said tubular members include a fifth tubular member having a first end securely attached to said cross-shaped connecting member with said fifth tubular member extending outwardly therefrom in a direction opposite to said fourth tubular member, and also having a second end which is securely attached to a fourth said elbow connecting member.

16. A shower cleaning apparatus as described in claim 15, wherein said one or more nozzles include a second nozzle which is securely attached to said third elbow connecting member and being adapted to be suspended above the bathtub or shower stall; and also include a third nozzle which is securely attached to said fourth elbow connecting member and being adapted to be suspended above the bathtub or shower stall.

* * * * *